US009827793B2

(12) United States Patent
Liang

(10) Patent No.: US 9,827,793 B2
(45) Date of Patent: Nov. 28, 2017

(54) SYNCHRONOUS SINGLE/DOUBLE-SIDED DIGITAL INKJET PRINTER AND WINDING METHOD THEREOF

(71) Applicant: Jian Liang, Liaoning (CN)

(72) Inventor: Jian Liang, Liaoning (CN)

( * ) Notice: Subject to any disclaimer, the term of this patent is extended or adjusted under 35 U.S.C. 154(b) by 0 days.

(21) Appl. No.: 15/124,515

(22) PCT Filed: Nov. 5, 2014

(86) PCT No.: PCT/CN2014/090320

§ 371 (c)(1),
(2) Date: Sep. 8, 2016

(87) PCT Pub. No.: WO2015/139463

PCT Pub. Date: Sep. 24, 2015

(65) Prior Publication Data

US 2017/0015119 A1 Jan. 19, 2017

(30) Foreign Application Priority Data

Mar. 18, 2014 (CN) ..... 2014 1 0100501

(51) Int. Cl.
*B41J 13/03* (2006.01)
*B41J 2/01* (2006.01)
(Continued)

(52) U.S. Cl.
CPC ..... *B41J 13/03* (2013.01); *B41J 2/01* (2013.01); *B41J 3/60* (2013.01); *B41J 3/62* (2013.01); *B41J 15/22* (2013.01)

(58) Field of Classification Search
CPC . B41J 3/543; B41J 15/04; B41J 15/22; B65H 23/32
See application file for complete search history.

(56) References Cited

U.S. PATENT DOCUMENTS 5,428,375 A * 6/1995 Simon ..... B41J 2/155 347/12
5,764,263 A * 6/1998 Lin ..... B41J 11/0015 347/101

(Continued)

FOREIGN PATENT DOCUMENTS

CN 101941334 A 1/2011
CN 102834269 A 12/2012
CN 203157371 U 8/2013

OTHER PUBLICATIONS

Written Opinion of the International Searching Authority for PCT/CN2014/090320 dated Feb. 4, 2015. (9 pages Chinese with English Translation).

(Continued)

*Primary Examiner* — Manish S Shah
*Assistant Examiner* — John P Zimmermann
(74) *Attorney, Agent, or Firm* — Smith, Gambrell & Russell, LLP

(57) ABSTRACT

A synchronous single/double-sided digital inkjet printer comprises a rack, feeding rollers (2, 23), take-up rollers (3, 22), two groups of inkjet printing carriages (9, 16) and driving rollers (5, 20). The two groups of inkjet printing carriages (9, 16) respectively make reciprocating motion on the two groups of track beams (10, 15) mounted on the rack, and are provided with print heads (8, 17). The lower parts of the two groups of inkjet printing carriages (9, 16) are provided with inkjet printing platforms (7, 19) mounted on the rack, and the lower parts of the two inkjet printing carriages (9, 16) are provided with the driving rollers (5, 20). The two driving rollers (5, 20) are driven to rotate in the opposite direction respectively by two independent driving devices mounted on the rack. A printing material winding method is applied to the inkjet printer. The inkjet printer and the method can not only accurately print on two sides (Continued)

synchronously, but also perform a single-sided printing on two pieces of printing materials by the same printer at the same time, thus realizing multi purposes by one machine.

14 Claims, 5 Drawing Sheets

(51) Int. Cl.

| | |
|---|---|
| ***B41J 3/60*** | (2006.01) |
| ***B41J 3/62*** | (2006.01) |
| ***B41J 15/22*** | (2006.01) |

(56) References Cited

U.S. PATENT DOCUMENTS 6,120,142 A * 9/2000 Eltgen ..... B41J 3/60 242/615.12
6,593,953 B1 * 7/2003 Ross ..... B41J 3/54 347/221
6,615,717 B1 * 9/2003 Perdu ..... B65H 23/32 101/180
6,916,132 B2 * 7/2005 Otsuka ..... B41J 3/60 400/188
7,393,073 B2 * 7/2008 Zach ..... B41J 3/28 347/12
8,033,624 B2 * 10/2011 Silva ..... B41J 2/155 347/4
8,397,663 B2 * 3/2013 Kojima ..... B41J 2/2103 118/314
9,079,426 B2 * 7/2015 Helterline ..... B41J 3/60
2002/1195008 12/2002 Perdu
2011/0243634 A1 10/2011 Kagami et al.

OTHER PUBLICATIONS

International Preliminary Report on Patentability for PCT/CN2014/090320 dated Sep. 20, 2016. (11 pages Chinese with English Translation).
International Search Report for PCT/CN2014/090320, dated Feb. 5, 2015 in English and Chinese Language.

* cited by examiner

SYNCHRONOUS SINGLE/DOUBLE-SIDED DIGITAL INKJET PRINTER AND WINDING METHOD THEREOF

TECHNICAL FIELD

The present invention relates to an inkjet printing device, and particularly to a synchronous single/double-sided digital inkjet printer and a winding method thereof.

BACKGROUND

At present, an inkjet printer capable of performing a double-sided printing is already increasingly used in the industry. Because the inkjet printer can print on the front side and the back side of the inkjet printing material, when light box advertising is made, images with bright and full colors are popular among industrial personnel.

Most of the existing double-sided inkjet printers adopt a step-by-step inkjet printing mode, i.e., firstly printing one side of the inkjet printing material, then removing the printing material and turning over and mounting the printing material on the inkjet printer for printing the other side of the printing material. The double-sided inkjet printers not only consume workers and time, but also have difficulty in ensuring fore-and-aft alignment precision.

With the continuous development, synchronous double-sided inkjet printers also appear. However, when printing double sides, these synchronous double-sided inkjet printers have relatively low synchronous inkjet printing precision and large error of front and back alignment and generate double images or non-distinct pattern in appearances of printed patterns. In addition, when printing single side, the print heads group for printing the back side is idle, thereby wasting 50% of print heads resources.

SUMMARY

To solve the problems of low synchronization precision, low speed in single-sided printing and idle print heads in the existing synchronous double-sided inkjet printers, the purpose of the present invention is to provide a synchronous single/double-sided digital inkjet printer and a winding method thereof.

The purpose of the present invention is realized by the following technical solution:

The synchronous single/double-sided digital inkjet printer of the present invention comprises a rack, feeding rollers, take-up rollers, two groups of inkjet printing carriages and driving rollers. The two groups of inkjet printing carriages respectively make reciprocating motion on two groups of track beams mounted on the rack, and are provided with print heads. The lower parts of the two groups of inkjet printing carriages are provided with inkjet printing platforms mounted on the rack, and the lower parts of the two inkjet printing carriages are provided with the driving rollers. The two driving rollers are driven to rotate in the opposite directions respectively by two independent driving devices mounted on the rack. The feeding rollers and the take-up rollers are respectively mounted on the rack on two sides of the two driving rollers or the outer side of each driving roller is provided with a group of feeding rollers and take-up rollers mounted on the rack. A single-sided inkjet printing material on the feeding rollers is driven by one driving roller, and taken up by a same-sided take-up roller. A double-sided inkjet printing material on the feeding rollers is driven by the two driving rollers, and taken up by an opposite-sided take-up roller.

Wherein: the two groups of inkjet printing carriages are a back side inkjet printing carriage and a front side inkjet printing carriage. The lower parts of the back side inkjet printing carriage and the front side inkjet printing carriage are respectively provided with a back side inkjet printing platform and a front side inkjet printing platform. The two driving rollers are a first driving roller and a second driving roller. The first and the second driving rollers are symmetrically mounted on the rack. A highest point of the first driving roller is positioned below the inkjet printing surface of the back side inkjet printing platform or is as high as the back side inkjet printing platform. A highest point of the second driving roller is positioned below the inkjet printing surface of the front side inkjet printing platform or is as high as the front side inkjet printing platform. The first driving roller and the second driving roller are respectively positioned on the outlet-direction saids of the back side inkjet printing platform and the front side inkjet printing platform. The outer sides of the first driving roller and the second driving roller are respectively provided with two rollers mounted on the rack. Two rollers on each side are respectively a feeding roller and a take-up roller in single-sided inkjet printing. The printing material on the feeding roller on each side is driven by the driving roller on the side, and taken up by a same-sided take-up roller. The outer side of the first driving roller is provided with the first feeding roller and the first take-up roller respectively mounted on the rack. The printing material on the first feeding roller is driven by the first driving roller, and taken up by the first take-up roller. The outer side of the second driving roller is provided with a second feeding roller and a second take-up roller respectively mounted on the rack. The printing material on the second feeding roller is driven by the second driving roller, and taken up by the second take-up roller.

The outer sides of the first driving roller and the second driving roller are respectively provided with two rollers mounted on the rack. In double-sided printing, any of the two rollers on one side is a feeding roller and any of the two rollers on the other side is a take-up roller. The printing material on the feeding rollers is driven by the first and the second driving rollers, and taken up by the take-up rollers. The front side and the back side of the printing material successively come into contact with the first and the second driving rollers. The first and the second driving rollers are driven to synchronously rotate in the opposite directions respectively by two independent driving devices.

The lower parts of the first and the second driving rollers are provided with clamping rollers respectively mounted on the rack. The printing material passes between the first driving roller and the clamping rollers or between the second driving roller and the clamping rollers. A plurality of guiding rollers for changing the passing direction of the printing material are arranged on the rack.

The synchronous single/double-sided digital inkjet printer is equivalent to two single-sided inkjet printers in single-sided printing, i.e., the printing material between the feeding roller and the take-up roller on the outer side of the first driving roller is driven by the first driving roller, and printed when passing through the back side inkjet printing carriage and the printing material between the feeding roller and the take-up roller on the outer side of the second driving roller is driven by the second driving roller, and printed when passing through the front side inkjet printing carriage.

In double-sided printing, the winding routes of the printing materials between the feeding rollers and take-up rollers on the outer sides of the first and the second driving rollers have a shape of "S"; the printing material successively wind through the back side inkjet printing platform, the first driving roller, the front side inkjet printing platform and the second driving roller, and are driven by the first and the second driving rollers; one side of the printing material is firstly printed by the print heads on the back side inkjet printing carriage, and then is exchanged with the other side between the first and the second driving rollers; and the other side of the printing material is printed by the print heads on the front side inkjet printing carriage, to realize double-sided printing.

The synchronous single/double-sided digital inkjet printer of the present invention comprises a rack, feeding rollers, take-up rollers, two groups of inkjet printing carriages and driving rollers. The two groups of inkjet printing carriages respectively make reciprocating motion on two groups of track beams mounted on the rack, and are provided with print heads. The lower parts of the two groups of inkjet printing carriages are provided with inkjet printing platforms mounted on the rack, and the lower parts of the two inkjet printing carriages are provided with the driving rollers. The two driving rollers are driven to rotate in the same direction respectively by two independent driving devices mounted on the rack. The feeding rollers and the take-up rollers are respectively mounted on the rack on two sides of the two driving rollers. The double-speed single-sided inkjet printing material on the feeding rollers is driven by the two driving rollers which rotate in the same direction, and taken up by the take-up rollers on the other side.

Wherein: the two groups of inkjet printing carriages are a back side inkjet printing carriage and a front side inkjet printing carriage. The lower parts of the back side inkjet printing carriage and the front side inkjet printing carriage are respectively provided with a back side inkjet printing platform and a front side inkjet printing platform. The two driving rollers are a first driving roller and a second driving roller. The first and the second driving rollers are symmetrically mounted on the rack. A highest point of the first driving roller is positioned below the inkjet printing surface of the back side inkjet printing platform or is as high as the back side inkjet printing platform. A highest point of the second driving roller is positioned below the inkjet printing surface of the front side inkjet printing platform or is as high as the front side inkjet printing platform. The first driving roller is positioned on one side of the inlet direction of the back side inkjet printing platform, and the second driving roller is positioned on one side of the outlet direction of the front side inkjet printing platform. The outer sides of the first driving roller and the second driving roller are respectively provided with two rollers mounted on the rack. In double-speed single-sided printing, any of the two rollers on one side is a feeding roller and any of the two rollers on the other side is a take-up roller. The printing material on the feeding rollers is driven by the first and the second driving rollers, and taken up by the take-up rollers. The back side of the printing material successively comes into contact with the first and the second driving rollers. The first and the second driving rollers are driven to synchronously rotate in the same direction respectively by two independent driving devices.

When the synchronous single/double-sided digital inkjet printer performs double-speed single-sided printing, the printing material on the feeding roller on the outer side of the first driving roller successively winds through the first driving roller, the back side inkjet printing platform, the front side inkjet printing platform and the second driving roller, and is driven by the first and the second driving rollers; The front side of the printing material is firstly printed by the print heads on the back side inkjet printing carriage by half of the number of passes, and is printed by the print heads on the front side inkjet printing carriage by the remaining half of the number of passes, to realize double-speed single-sided printing.

The present invention has the following advantages and positive effects:

1. In the present invention, one driving roller is arranged below each inkjet printing platform, and the two driving rollers are driven to synchronously rotate in the opposite directions respectively by the independent driving devices, thereby ensuring stepping precision of double-sided printing.

2. The present invention can not only accurately perform a double-sided printing synchronously, but also perform a single-sided printing on two pieces of printing materials by the same printer at the same time, thereby realizing multi-purposes by one printer.

3. The inkjet printing surface of the present invention can be a plane or cambered surface; if the inkjet printing surface is plane, the inkjet printing surface is applicable to wide print heads printing while ensuring the inkjet printing precision; and the planar inkjet printing surface is also applicable to installation of a plurality of groups of print heads without increasing the roller diameter, which is more convenient for alignment operation.

DETAILED DESCRIPTION

The present invention is further detailed below in combination with the drawings.

The digital inkjet printer of the present invention comprises a rack, feeding rollers, take-up rollers, two groups of inkjet printing carriages and driving rollers. The two groups of inkjet printing carriages respectively make reciprocating motion on two groups of track beams mounted on the rack, and are provided with print heads. The lower parts of the two groups of inkjet printing carriages are provided with inkjet printing platforms mounted on the rack; each inkjet printing surface of the inkjet printing platforms can be a plane or cambered surface; and the lower parts of the two inkjet printing carriages are provided with the driving rollers. The two driving rollers are driven to rotate in the opposite directions respectively by two independent driving devices mounted on the rack. The feeding rollers and the take-up rollers are respectively mounted on the rack on two sides of the two driving rollers or the outer side of each driving roller is provided with a group of feeding rollers and take-up rollers mounted on the rack. A single-sided inkjet printing material 24 on the feeding rollers is driven by one driving roller, and taken up by a same-sided take-up roller. A double-sided inkjet printing material 24 on the feeding rollers is driven by the two driving rollers, and taken up by an opposite-sided take-up roller.

Embodiment 1 (Single-Sided Printing)

Figure 1:
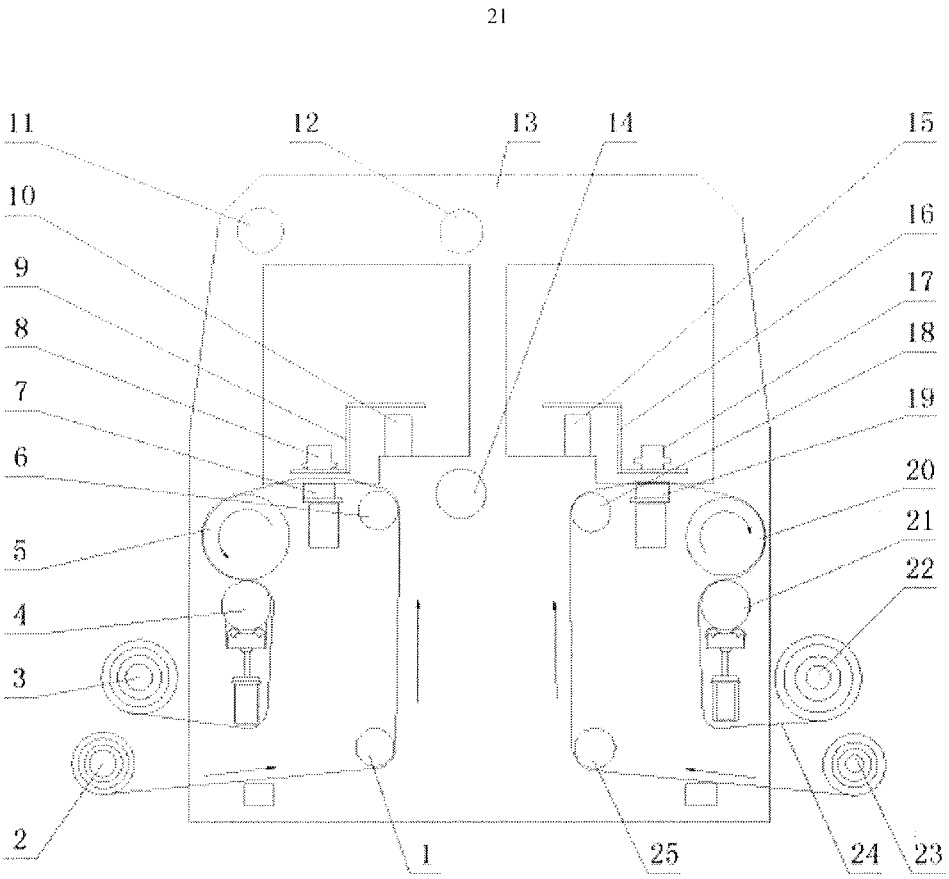
FIG. 1 is a structural diagram of embodiment 1 of an inkjet printer of the present invention (single-sided printing)

The digital inkjet printer of the embodiment can perform a single-sided printing on two pieces of printing materials 24 by the same printer at the same time to form a double-speed digital inkjet printer; and one printer has double speeds so as to perform two single-sided printings at the same time. As shown in FIG. 1, the digital inkjet printer of the embodiment comprises a rack, feeding rollers, take-up rollers, a back side inkjet printing carriage 9, a front side inkjet printing carriage 16, a first driving roller 5 and a second driving roller 20. The rack consists of wallboards 13 on both sides and track beams mounted between the two wallboards 13. The first and the second driving rollers 5,20 are symmetrically arranged, and are rotatably mounted on the wallboards 13 respectively. The outer sides of the first driving roller 5 and the second driving roller 20 are respectively provided with two rollers mounted on the rack. Two rollers on the outer side of the first driving roller 5 are a first feeding roller 2 and a first take-up roller 3, and two rollers on the outer side of the second driving roller 20 are a second feeding roller 23 and a second take-up roller 22. The first take-up roller 3 and the first feeding roller 2 on the same side are arranged vertically and positioned on the lower part of the outer side of the first driving roller 5 for facilitating take-up and feeding for operators. The second take-up roller 22 and the second feeding roller 23 on the same side are arranged vertically and positioned on the lower part of the outer side of the second driving roller 20 for facilitating take-up and feeding for operators. The lower part of the first driving roller 5 is provided with a first clamping roller 4 mounted on the rack, and the lower part of the second driving roller 20 is provided with a second clamping roller 21 mounted on the rack. The first and the second clamping rollers 4,21 are respectively abutted against with the first and the second driving rollers 5,20 under the function of a cylinder, depending on the needs of conveying printing material.

The rack is provided with a back side inkjet printing track beam 10 and a front side inkjet printing track beam 15. The two track beams are mutually parallel and are also parallel with a horizontal plane. The back side inkjet printing carriage 9 and the front side inkjet printing carriage 16 can respectively make reciprocating motion along the lengthwise directions of the back side printing track beam 10 and the front side inkjet printing track beam 15. The back side inkjet printing carriage 9 is provided with a first print head 8, and the front side inkjet printing carriage 16 is provided with a second print head 17. The lower parts of the back side inkjet printing carriage 9 and the front side inkjet printing carriage 16 are respectively provided with the back side inkjet printing platform 7 and the front side inkjet printing platform 19 mounted on the wallboards 13. The upper surfaces of the back side inkjet printing platform 7 and the front side inkjet printing platform 19 are the inkjet printing surfaces of the printing materials 24 on the two inkjet printing platforms. The inkjet printing surfaces of the two inkjet printing platforms can be planes and are parallel with the horizontal plane or can be cambered surfaces.

The first driving roller 5 and the second driving roller 20 are respectively positioned on one side of each of the outlet directions of the back side inkjet printing platform 7 and the front side inkjet printing platform 19. The highest point of the first driving roller 5 is positioned below the inkjet printing surface of the back side inkjet printing platform 7 or is as high as the back side inkjet printing platform 7. The highest point of the second driving roller 20 is positioned below the inkjet printing surface of the front side inkjet printing platform 19 or is as high as the front side inkjet printing platform 19. In the embodiment, the first driving roller 5 is positioned on the left side below the back side inkjet printing platform 7, and the second driving roller 20 is positioned on the right side below the front side inkjet printing platform 19. A plurality of guiding rollers for changing the passing direction of the printing material 24 are arranged on the rack. In the embodiment, seven guiding rollers mounted on the wallboards 13 are provided, i.e., a second guiding roller 6 positioned on the right side of the back side inkjet printing platform 7, a first guiding roller 1 positioned below the second guiding roller 6 and positioned on the right side below the first driving roller 5 and the first clamping roller 4, a third guiding roller 11 and a fourth guiding roller 12 which are positioned on the left side and the right side above the back side inkjet printing platform 7, a sixth guiding roller 18 positioned on the left side of the front side inkjet printing platform 19, a seventh guiding roller 25 positioned below the sixth guiding roller 18 and positioned on the left side below the second driving roller 20 and the second clamping roller 21, and a fifth guiding roller 14 positioned in front of the second guiding roller and the sixth guiding roller 18 and positioned below the fourth guiding roller 12.

The printing material 24 on the first feeding roller 2 is driven by the first driving roller 5, and taken up by the same-sided first take-up roller 3. The printing material 24 on the second feeding roller 23 is driven by the second driving roller 20, and taken up by the same-sided second take-up roller 22.

A printing material winding method of the embodiment is as follows:

The digital inkjet printer of the embodiment is equivalent to two single-sided inkjet printers in single-sided printing. The printing material 24 on the first feeding roller 2 is wound on the first driving roller 5 after successively winding through the first guiding roller 1, the second guiding roller 6 and the back side inkjet printing platform 7, penetrates between the first driving roller 5 and the first clamping roller 4, and is finally wound on the first take-up roller 3; the printing material 24 is driven by the first driving roller 5; the single side of the printing material 24 is printed by a first print head 8 on the back side inkjet printing carriage 9; and the printing material 24 is taken up by the first take-up roller 3. Similarly, the printing material 24 on the second feeding roller 23 is wound on the second driving roller 20 after successively winding through the seventh guiding roller 25, the sixth guiding roller 18 and the front side inkjet printing platform 19, penetrates between the second driving roller 20 and the second clamping roller 21, and is finally wound on the second take-up roller 22; the printing material 24 is driven by the second driving roller 20; the single side of the printing material 24 is printed by a second print head 17 on the front side inkjet printing carriage 16; and the printing material 24 is taken up by the second take-up roller 22. In single-sided printing, the first and the second driving rollers 5,20 can rotate synchronously or non-synchronously, depending on actual needs.

Embodiment 2 (Single-Sided Printing)

Figure 2:
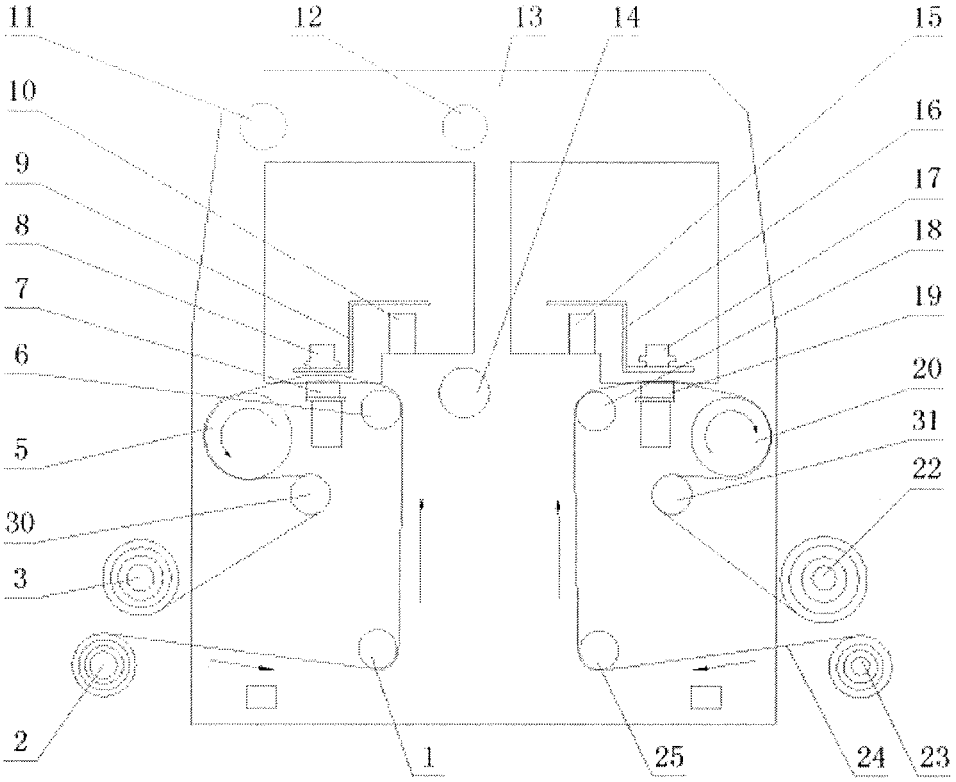
FIG. 2 is a structural diagram of embodiment 2 of an inkjet printer of the present invention (single-sided printing)

As shown in FIG. 2, the difference between embodiment 2 and embodiment 1 is that the first and the second clamping rollers 4,21 are replaced by the eighth guiding roller 30 and the ninth guiding roller 31. The eighth guiding roller 30 is positioned on the lower part of the right side of the first driving roller 5, and the ninth guiding roller 31 is positioned on the lower part of the left side of the second driving roller 20.

A printing material winding method of the embodiment is as follows:

The digital inkjet printer of the embodiment is equivalent to two single-sided inkjet printers in single-sided printing. The printing material 24 on the first feeding roller 2 is wound on the first driving roller 5 after successively winding through the first guiding roller 1, the second guiding roller 6 and the back side inkjet printing platform 7, penetrates between the first driving roller 5 and the eighth guiding roller 30, and is finally wound on the first take-up roller 3; the printing material 24 is driven by the first driving roller 5; the single side of the printing material 24 is printed by a first print head 8 on the back side inkjet printing carriage 9; and the printing material 24 is taken up by the first take-up roller 3. Similarly, the printing material 24 on the second feeding roller 23 is wound on the second driving roller 20 after successively winding through the seventh guiding roller 25, the sixth guiding roller 18 and the front side inkjet printing platform 19, penetrates between the second driving roller 20 and the ninth guiding roller 31, and is finally wound on the second take-up roller 22; the printing material 24 is driven by the second driving roller 20; the single side of the printing material 24 is printed by a second print head 17 on the front side inkjet printing carriage 16; and the printing material 24 is taken up by the second take-up roller 22. In single-sided printing, the first and the second driving rollers 5,20 can rotate synchronously or non-synchronously, depending on actual needs.

Embodiment 3 (Double-Sided Printing)

Figure 3:
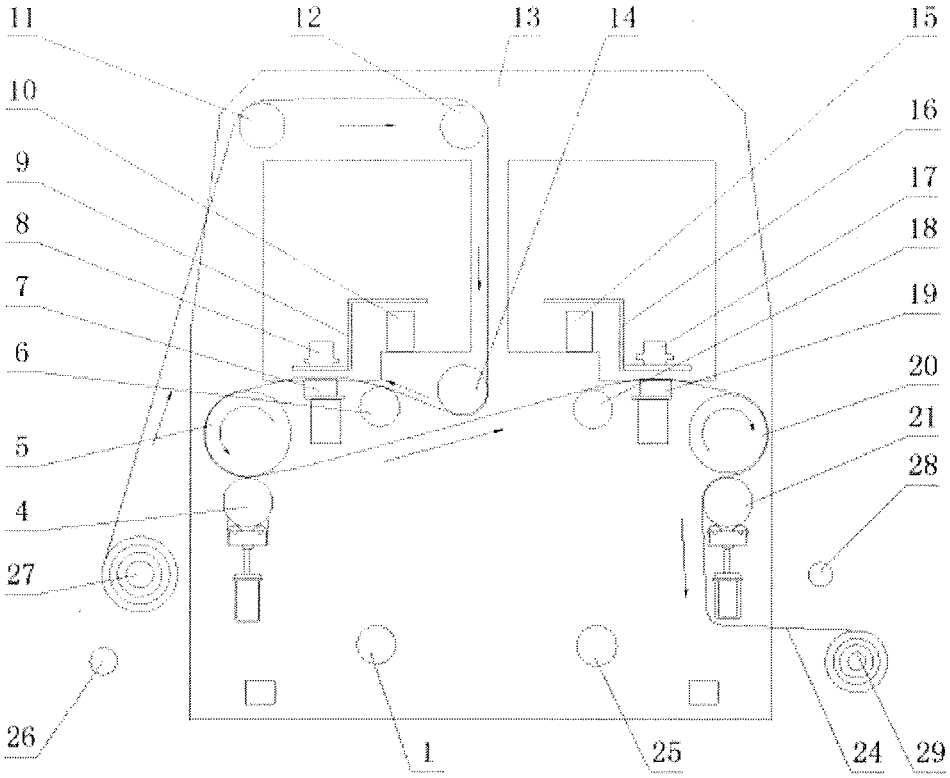
FIG. 3 is a structural diagram of embodiment 3 of an inkjet printer of the present invention (double-sided printing)

As shown in FIG. 3, the difference between embodiment 3 and embodiment 1 is that two rollers on the outer side of the first driving roller 5 in embodiment 1 are respectively the first take-up roller 3 positioned on the upper part and the first feeding roller 2 positioned on the lower part; however, in embodiment 3, the first take-up roller 3 as a double-sided inkjet printing feeding roller 27 performs feeding, and the first feeding roller 2 which still acts as a single-sided inkjet printing feeding roller 26 does not participate in operation in embodiment 3. Similarly, two rollers on the outer side of the second driving roller 20 in embodiment 1 are respectively the second take-up roller 22 positioned on the upper part and the second feeding roller 23 positioned on the lower part; however, in embodiment 3, the second take-up roller 22 which still acts as a single-sided inkjet printing take-up roller 28 does not participate in operation in embodiment 3, and the second feeding roller 23 as a double-sided inkjet printing take-up roller 29 performs take-up. The front side and the back side of the printing material 24 of embodiment 3 successively come into contact with the first and the second driving rollers 5,20. The first and the second driving rollers 5,20 are driven to synchronously rotate in the opposite directions respectively by two independent driving devices.

The first clamping roller 4 and the second clamping roller 21 in embodiment 3 can be simultaneously abutted against the first driving roller 5 and the second driving roller 20, or the first clamping roller 4 is abutted against the first driving roller 5, or not abutted, depending on the take-up force of the double-sided inkjet printing take-up roller 29.

A printing material winding method of the embodiment is as follows:

When the digital inkjet printer of embodiment 3 performs double-sided printing, a winding route of the printing material 24 between the double-sided inkjet printing feeding roller 27 and the double-sided inkjet printing take-up roller 29 has a shape of "S"; the printing material 24 on the double-sided inkjet printing feeding roller 27 positioned on one side of the rack is wound on the double-sided inkjet printing take-up roller 29 positioned on the other side of the rack after successively winding through the third guiding roller 11, the fourth guiding roller 12, the fifth guiding roller 14, the second guiding roller 6, the back side inkjet printing platform 7, the first driving roller 5 (penetrating between the first driving roller 5 and the first clamping roller 4), the sixth guiding roller 18, the front side inkjet printing platform 19, and the second driving roller 20 (penetrating between the second driving roller 20 and the second clamping roller 21). One side of the printing material 24 is firstly printed by the first print head 8 on the back side inkjet printing carriage 9, and then is exchanged between the first driving roller 5 and the second driving roller 20; the other side of the printing material 24 is printed by the second print head 17 on the front side inkjet printing carriage 16 to realize double-sided printing of the printing material 24; and the printing material 24 with printed double sides is taken up by the double-sided inkjet printing take-up roller 29. In embodiment 3, when the printing material 24 is subjected to double-sided printing, the first and the second driving rollers 5,20 synchronously rotate in the opposite rotations, thereby ensuring double-sided inkjet printing precision; and moreover, the printing material 24 has no crease in the passing process.

Embodiment 4 (Double-Sided Printing)

Figure 4:
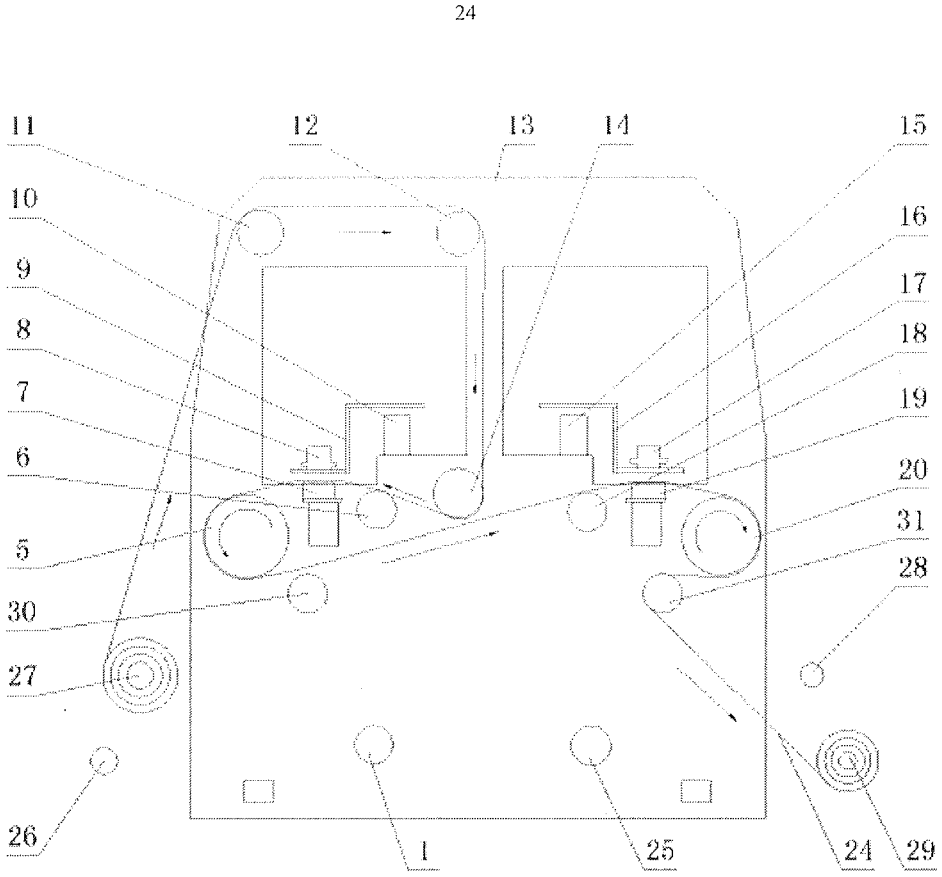
FIG. 4 is a structural diagram of embodiment 4 of an inkjet printer of the present invention (double-sided printing)

As shown in FIG. 4, the difference between embodiment 4 and embodiment 3 is that the first and the second clamping rollers 4,21 are replaced by the eighth guiding roller 30 and the ninth guiding roller 31. The eighth guiding roller 30 is positioned on the lower part of the right side of the first driving roller 5, and the ninth guiding roller 31 is positioned on the lower part of the left side of the second driving roller 20.

A printing material winding method of the embodiment is as follows:

When the digital inkjet printer of embodiment 4 performs double-sided printing, a winding route of the printing material 24 between the double-sided inkjet printing feeding roller 27 and the double-sided inkjet printing take-up roller 29 has a shape of "S"; the printing material 24 on the double-sided inkjet printing feeding roller 27 positioned on one side of the rack is wound on the double-sided inkjet printing take-up roller 29 positioned on the other side of the rack after successively winding through the third guiding roller 11, the fourth guiding roller 12, the fifth guiding roller 14, the second guiding roller 6, the back side inkjet printing platform 7, the first driving roller 5 (penetrating between the first driving roller 5 and the eighth guiding roller 30), the sixth guiding roller 18, the front side inkjet printing platform 19, and the second driving roller 20 (penetrating between the second driving roller 20 and the ninth guiding roller 31). One side of the printing material 24 is firstly printed by the first print head 8 on the back side inkjet printing carriage 9, and then is exchanged between the first driving roller 5 and the second driving roller 20; the other side of the printing material 24 is printed by the second print head 17 on the front side inkjet printing carriage 16 to realize double-sided printing of the printing material 24; and the printing material 24 with printed double sides is taken up by the double-sided inkjet printing take-up roller 29. In embodiment 3, when the printing material 24 is subjected to double-sided printing, the first and the second driving rollers 5,20 synchronously rotate in the opposite rotations, thereby ensuring double-sided inkjet printing precision; and moreover, the printing material 24 has no crease in the passing process.

Embodiment 5 (Double-Speed Single-Sided Printing)

Figure 5:
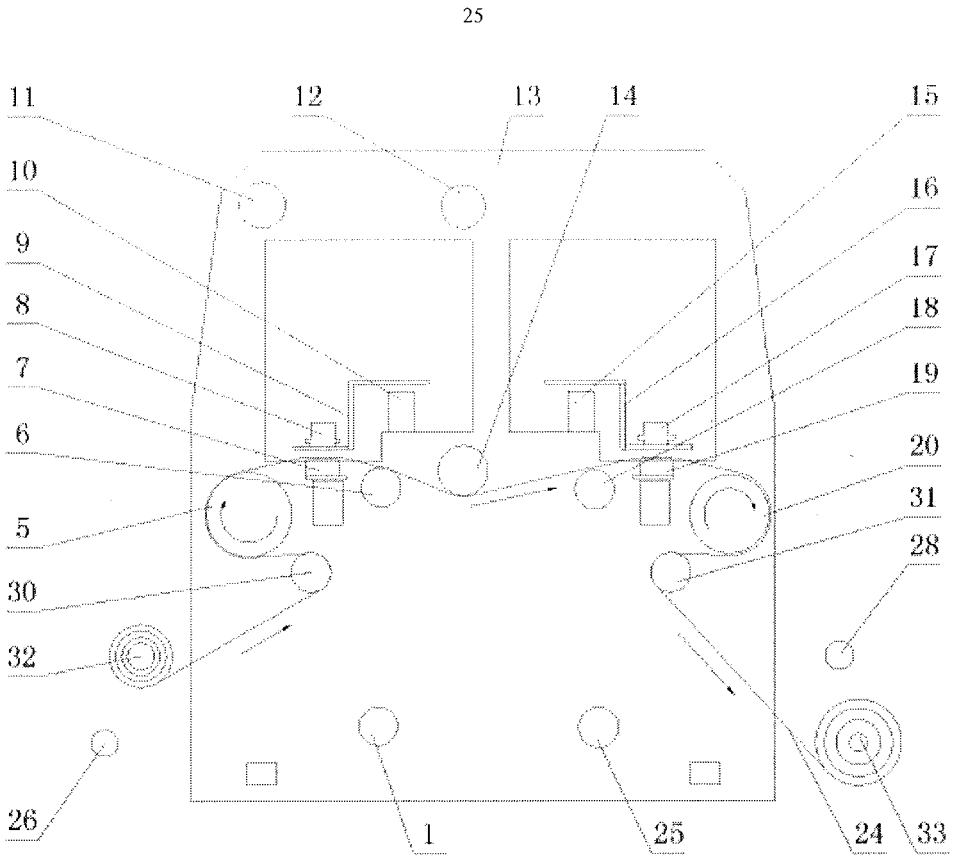
FIG. 5 is a structural diagram of embodiment 5 of an inkjet printer of the present invention (double-speed single-sided printing), wherein: 1—first guiding roller; 2—first feeding roller; 3—first take-up roller; 4—first clamping roller; 5—first driving roller; 6—second guiding roller; 7—back side inkjet printing platform; 8—first print head; 9—back side inkjet printing carriage; 10—back side inkjet printing track beam; 11—third guiding roller; 12—fourth guiding roller; 13—wallboard; 14—fifth guiding roller; 15—front side inkjet printing track beam; 16—front side inkjet printing carriage; 17—second print head; 18—sixth guiding roller; 19—front side inkjet printing platform; 20—second driving roller; 21—second clamping roller; 22—second take-up roller; 23—second feeding roller; 24—printing material; 25—seventh guiding roller; 26—single-sided inkjet printing feeding roller; 27—double-sided inkjet printing feeding roller; 28—single-sided inkjet printing take-up roller; 29—double-sided inkjet printing take-up roller; 30—eighth guiding roller; 31—ninth guiding roller; 32—double-speed single-sided inkjet printing feeding roller; and 33—double-speed single-sided inkjet printing take-up roller.

As shown in FIG. 5, the difference between embodiment 5 and embodiment 1 is that two rollers on the outer side of the first driving roller 5 in embodiment 1 are respectively the first take-up roller 3 positioned on the upper part and the first feeding roller 2 positioned on the lower part; however, in present embodiment, the first take-up roller 3 as a double-speed single-sided inkjet printing feeding roller 32 performs feeding, and the first feeding roller 2 which still acts as a single-sided inkjet printing feeding roller 26 does not participate in operation in present embodiment. Similarly, two rollers on the outer side of the second driving roller 20 in embodiment 1 are respectively the second take-up roller 22 positioned on the upper part and the second feeding roller 23 positioned on the lower part; however, in embodiment 5, the second take-up roller 22 which still acts as a single-sided inkjet printing take-up roller 28 does not participate in operation in embodiment 5, and the second feeding roller 23 as a double-speed single-sided inkjet printing take-up roller 33 performs drawing. The back side of the printing material 24 of embodiment 5 successively comes into contact with the first and the second driving rollers 5,20. The first and the second driving rollers 5,20 are driven to synchronously rotate in the same direction respectively by two independent driving devices.

In embodiment 5, the eighth guiding roller 30 and the ninth guiding roller 31 can also be replaced by the first clamping roller 4 and the second clamping roller 21.

A printing material winding method of the embodiment is as follows:

When the digital inkjet printer of embodiment 5 performs double-speed single-sided printing, the printing material 24 on the single-sided inkjet printing feeding roller 32 positioned on one side of the rack is wound on the double-speed single-sided inkjet printing take-up roller 33 positioned on the other side of the rack after successively winding through the eighth guiding roller 30, the first driving roller 5 (penetrating between the first driving roller 5 and the eighth guiding roller 30), the back side inkjet printing platform 7, the second guiding roller 6, the fifth guiding roller 14, the sixth guiding roller 18 (after coming out of the back side inkjet printing platform 7, entering the front side inkjet printing platform 19 through the upper part of the second guiding roller 6, the lower part of the fifth guiding roller 14 and the upper part of the sixth guiding roller 18), the front side inkjet printing platform 19, the second driving roller 20 (penetrating between the second driving roller 20 and the ninth guiding roller 31) and the ninth guiding roller 31. The front side of the printing material 24 is firstly printed by the first print head 8 on the back side inkjet printing carriage 9 by half of the number of passes (the number of times of printing required for forming an image, i.e., the number of times of coverage per unit area), and is printed by the second print head 17 on the front side inkjet printing carriage 16 by the remaining half of the number of passes, to realize double-speed single-sided printing of the printing material 24. The printing material 24 after double-speed single-sided printing is taken up by the double-speed single-sided inkjet printing take-up roller 33. In embodiment 5, when the printing material 24 is subjected to double-speed single-sided printing, the first and the second driving rollers 5,20 synchronously rotate in the same rotation.

The present invention can realize single-sided printing on two pieces of printing materials by the same printer at the same time, can realize synchronous double-sided printing by using two groups of print heads, and can also realize printing of one printing material 24 by half of the number of passes; and the back side inkjet printing carriage 9 firstly performs printing by half of the number of passes, and the front side inkjet printing carriage 16 then finishes the remaining half, thereby realizing multi purposes by one printer.

I claim:

1. A synchronous single/double-sided digital inkjet printer, comprising:

a rack, feeding rollers, take-up rollers, two groups of inkjet printing carriages, driving rollers, and a plurality of guiding rollers, wherein the two groups of inkjet printing carriages are configured to respectively make reciprocating motion on two groups of track beams mounted on the rack, and are provided with respective print heads;

lower parts of the two groups of inkjet printing carriages are provided with respective inkjet printing platforms mounted on the rack, the lower parts of the two groups of inkjet printing carriages being provided with respective driving rollers;

the respective driving rollers are configured to be driven to rotate in opposite directions respectively by independent driving devices mounted on the rack;

the printer is configured for operating, selectively, to perform:

two separate single-sided printing procedures, with the outer side of each respective driving roller being provided with a feeding roller and a take-up roller, the respective driving rollers each being operable to drive printing material loaded on a respective feeding roller to be printed onto by a respective printing carriage and taken up by a respective take-up roller on the same side as the respective feeding roller; and a double-sided printing procedure, with a feeding roller being mounted on the outer side of a first driving roller and a take-up roller mounted oppositely on the outer side of a second driving roller, the respective driving rollers being operable to drive a printing material loaded on the feeding roller to be printed onto by the two groups of inkjet printing carriages and taken up by the take-up roller on the opposite side from the feeding roller; and the plurality of guiding rollers comprises all guiding rollers that change the passing direction of printing material in the single-sided printing procedures and all guiding rollers that change the passing direction of printing material in the double-sided printing procedure, and all guiding rollers in the plurality of guiding rollers are arranged such that an axial direction of each guiding roller is parallel to the axial direction of each of the other guiding rollers in the plurality of guiding rollers.

2. The synchronous single/double-sided digital inkjet printer according to claim 1, wherein the two groups of inkjet printing carriages are a back side inkjet printing carriage and a front side inkjet printing carriage;

the lower parts of the back side inkjet printing carriage and the front side inkjet printing carriage are respectively provided with a back side inkjet printing platform and a front side inkjet printing platform;

the respective driving rollers are the first driving roller and the second driving roller, the first and the second driving rollers being symmetrically mounted on the rack;

a highest point of the first driving roller is positioned below an inkjet printing surface of the back side inkjet printing platform or is as high as the back side inkjet printing platform;

a highest point of the second driving roller is positioned below an inkjet printing surface of the front side inkjet printing platform or is as high as the front side inkjet printing platform; and the first driving roller and the second driving roller are respectively positioned on outlet-direction sides of the back side inkjet printing platform and the front side inkjet printing platform.

3. The synchronous single/double-sided digital inkjet printer according to claim 2, wherein the outer sides of the first driving roller and the second driving roller are respectively provided with two rollers mounted on the rack; and the printer is configured such that, during a single-sided inkjet printing procedure:

the two rollers on the respective outer sides of the first and second driving rollers are a feeding roller and a take-up roller, and a printing material loaded on the feeding roller on each respective side is drivable by the respective driving roller on that same side to be taken up by the take-up roller on that same side.

4. The synchronous single/double-sided digital inkjet printer according to claim 3, wherein the outer side of the first driving roller is provided with a first feeding roller and a first take-up roller respectively mounted on the rack;

the outer side of the second driving roller is provided with a second feeding roller and a second take-up roller respectively mounted on the rack; and the printer is configured such that, during a single-sided inkjet printing procedure:

a printing material loaded on the first feeding roller is drivable by the first driving roller to be taken up by the first take-up roller; and a printing material loaded on the second feeding roller is drivable by the second driving roller to be taken up by the second take-up roller.

5. The synchronous single/double-sided digital inkjet printer according to claim 2, wherein the outer sides of the first driving roller and the second driving roller are respectively provided with two rollers mounted on the rack; and the printer is configured such that, during a double-sided printing procedure:

either of the two rollers on one of the outer sides is operable as a feeding roller and either of the two rollers on the other of the outer sides is operable as a take-up roller; and a printing material loaded on the feeding roller at the one side is drivable by the first and the second driving rollers to be taken up by the take-up roller at the other side.

6. The synchronous single/double-sided digital inkjet printer according to claim 5, wherein the printer is configured such that, during a double-sided printing procedure:

a front side and a back side of the printing material successively come into contact with the first and second driving rollers; and the first and second driving rollers are drivable to synchronously rotate in opposite directions respectively by two independent driving devices.

7. The synchronous single/double-sided digital inkjet printer according to claim 2, wherein lower parts of the first and second driving rollers are provided with clamping rollers respectively mounted on the rack; and the printer is configured such that, during a printing procedure, a printing material passes between the first driving roller and a respective clamping roller and/or between the second driving roller and a respective clamping roller.

8. The synchronous single/double-sided digital inkjet printer according to claim 1, wherein the respective driving rollers are further configured to be driven to rotate in the same direction respectively by the independent driving devices mounted on the rack; and the printer is further configured for operating, selectively, to perform:

a double-speed single-sided printing procedure, with a feeding roller being mounted on the outer side of the first driving roller and a take-up roller mounted oppositely on the outer side of the second driving roller, the respective driving rollers being operable to drive a printing material that is loaded on the feeding roller to be printed onto by the two groups of inkjet printing carriages and taken up by the take-up roller on the opposite side from the feeding roller.

9. The synchronous single/double-sided digital inkjet printer according to claim 8, wherein the two groups of inkjet printing carriages are a back side inkjet printing carriage and a front side inkjet printing carriage;

lower parts of the back side inkjet printing carriage and the front side inkjet printing carriage are respectively provided with a back side inkjet printing platform and a front side inkjet printing platform;

the respective driving rollers are the first driving roller and the second driving roller, the first and the second driving rollers being symmetrically mounted on the rack;

a highest point of the first driving roller is positioned below an inkjet printing surface of the back side inkjet printing platform or is as high as the back side inkjet printing platform;

a highest point of the second driving roller is positioned below an inkjet printing surface of the front side inkjet printing platform or is as high as the front side inkjet printing platform;

the first driving roller is positioned at an inlet side of the back side inkjet printing platform; and the second driving roller is positioned at an outlet side of the front side inkjet printing platform.

10. The synchronous single/double-sided digital inkjet printer according to claim 9, wherein the outer sides of the first driving roller and the second driving roller are respectively provided with two rollers mounted on the rack; and the printed is configured such that, during a double-speed single-sided printing procedure:

either of the two rollers on one of the outer sides is operable as the feeding roller and either of the two rollers on the other of the outer sides is operable as the take-up roller; and a printing material loaded on the feeding roller at the one side is drivable by the first and the second driving rollers to be taken up by the take-up roller at the other side.

11. The synchronous single/double-sided digital inkjet printer according to claim 10, wherein the printed is configured such that, during a double-speed single-sided printing procedure:

a back side of the printing material successively comes into contact with the first and the second driving rollers; and the first and second driving rollers are drivable to synchronously rotate in the same direction respectively by two independent driving devices.

12. A method of printing, comprising:

utilizing the synchronous single/double-sided digital inkjet printer according to claim 3 to perform a single-sided printing procedure, wherein a first printing material loaded on the feeding roller on the outer side of the driving roller is driven by the first driving roller, printed onto when passing through the back side inkjet printing carriage, and wound onto the take-up roller on the outer side of the first driving roller; and a second printing material loaded on the feeding roller on the outer side of the second driving roller is driven by the second driving roller, printed onto when passing through the front side inkjet printing carriage, and wound onto the take-up roller on the outer side of the second driving roller.

13. A method of printing, comprising:

utilizing the synchronous single/double-sided digital inkjet printer according to claim 5 to perform a double-sided printing procedure, wherein a winding route of a printing material between a feeding roller on the outer side of the first driving roller and a take-up roller on the outer side of the second driving roller has an "S" shape;

the printing material successively winds through the back side inkjet printing platform, the first driving roller, the front side inkjet printing platform, and the second driving roller, and is driven by the first and the second driving rollers; and a first side of the printing material is printed by the print head on the back side inkjet printing carriage, and a second side of the printing material is printed by the print head on the front side inkjet printing carriage.

14. A method of printing, comprising:

utilizing the synchronous single/double-sided digital inkjet printer according to claim 10 to perform a double-speed single-sided printing procedure, wherein a printing material loaded on the feeding roller on the outer side of the first driving roller successively winds through the first driving roller, the back side inkjet printing platform, the front side inkjet printing platform, and the second driving roller, and is driven by the first and the second driving rollers; and the front side of the printing material is printed onto by the print head on the back side inkjet printing carriage on a first half of a number of passes, and is printed onto by the print head on the front side inkjet printing carriage on the remaining half of the number of passes.

* * * * *